US007892360B2

(12) United States Patent
Mai

(10) Patent No.: US 7,892,360 B2
(45) Date of Patent: Feb. 22, 2011

(54) METHODS FOR REDUCING DEPOSITS IN PETROLEUM PIPES

(76) Inventor: Qi Ning Mai, 2601 Xie Tu Road, Building T2/12A, Shanghai (CN) 200030

( * ) Notice: Subject to any disclaimer, the term of this patent is extended or adjusted under 35 U.S.C. 154(b) by 0 days.

(21) Appl. No.: 12/793,482

(22) Filed: Jun. 3, 2010

(65) Prior Publication Data

US 2010/0242989 A1 Sep. 30, 2010

Related U.S. Application Data

(60) Division of application No. 12/185,604, filed on Aug. 4, 2008, now Pat. No. 7,730,899, which is a continuation-in-part of application No. 12/052,287, filed on Mar. 20, 2008, now abandoned.

(30) Foreign Application Priority Data

Mar. 20, 2007 (CN) ..... 2007 1 0038228

(51) Int. Cl.
*B08B 9/027* (2006.01)

(52) U.S. Cl. ..... 134/22.11; 134/1

(58) Field of Classification Search ..... None
See application file for complete search history.

(56) References Cited

U.S. PATENT DOCUMENTS

| | | | | |
|---|---|---|---|---|
| 4,938,875 | A | 7/1990 | Niessen | |
| 5,012,868 | A | 5/1991 | Bridges | |
| 5,074,998 | A * | 12/1991 | De Baat Doelman | 210/97 |
| 5,171,431 | A | 12/1992 | Schulte | |
| 5,453,188 | A * | 9/1995 | Florescu et al. | 210/222 |
| 5,645,697 | A | 7/1997 | Middleton et al. | |
| 5,665,221 | A | 9/1997 | Owen | |

(Continued)

FOREIGN PATENT DOCUMENTS

CN 99250279.9 8/2000

(Continued)

OTHER PUBLICATIONS

John Donaldson and Sue Grimes, "Lifting the scales from our pipes—Magnetic fields change the way crystals form in fluids. This could prevent the formation of scale in pipes and boilers." New Scientist 18, pp. 43-46, Feb. 1988.

(Continued)

*Primary Examiner*—Michael Kornakov
*Assistant Examiner*—Nicole Blan
(74) *Attorney, Agent, or Firm*—Knobbe, Martens, Olson & Bear, LLP

(57) ABSTRACT

Methods and apparatus for removing deposits from a petroleum flow line are disclosed. An example of one method includes generating an electric wave that includes a high frequency component having a high frequency in a range from approximately 25 kHz to approximately 65 kHz. The method further includes applying the electric wave to at least two field windings circumferentially disposed around a petroleum pipe while a petroleum fluid is flowing in the petroleum pipe. The method also includes generating, in response to the applied electric wave, magnetic fields in the at least two field windings. The magnetic fields in the at least two field windings can have magnetic axes that are not collinear with respect to each other.

19 Claims, 9 Drawing Sheets

U.S. PATENT DOCUMENTS

| | | | |
|---|---|---|---|
| 5,673,721 | A | 10/1997 | Alcocer et al. |
| 5,725,778 | A | 3/1998 | Cho et al. |
| 5,738,766 | A | 4/1998 | Jefferson |
| 5,899,220 | A | 5/1999 | Alcocer et al. |
| 6,496,448 | B1 | 12/2002 | Kompanek |
| 6,655,462 | B1 | 12/2003 | Carmichael et al. |
| 6,852,235 | B2 | 2/2005 | Holland |
| 7,137,449 | B2 | 11/2006 | Silguero |
| 7,264,056 | B2 | 9/2007 | Towler |
| 7,351,341 | B2 | 4/2008 | Tsuboi et al. |
| 7,730,899 | B2 | 6/2010 | Mai |
| 2001/0013413 | A1 | 8/2001 | Ruttley |
| 2003/0028287 | A1 | 2/2003 | Puskas |
| 2003/0155828 | A1 | 8/2003 | Cheung et al. |
| 2005/0161405 | A1 | 7/2005 | Holland |
| 2006/0048941 | A1 | 3/2006 | Borst et al. |

FOREIGN PATENT DOCUMENTS

| | | | |
|---|---|---|---|
| CN | 200710038228.X | | 3/2007 |
| DE | 4433784 | A1 | 7/1995 |
| EP | 460248 | B1 | 2/1994 |
| JP | 2001-259691 | A | 9/2001 |
| WO | WO 99/06324 | A1 | 2/1999 |
| WO | WO 2006/072125 | A1 | 7/2006 |
| WO | WO 2008/017849 | A1 | 2/2008 |
| WO | WO 2010/016828 | A1 | 2/2010 |

OTHER PUBLICATIONS

C.H. Sohn; C.S. Kim; S.Y. Moon; Y.I. Cho, "Effect of a longitudinally positioned solenoid coil on electronic descaling" Dept. of Mech. Eng., Kyungpook Nat. Univ., Sankyuk-Dong Puk-Gu Taegu, South Korea International Communications in Heat and Mass Transfer, vol. 32, No. 1-2, p. 240-247, Publisher: Elsevier, Published: Jan. 2005.

Y.I. Cho; W.T. Taylor, "An innovative electronic descaling technology for scale prevention in a chiller" Publisher: American Society of Heating, Refrigerating and Air-Conditioning Engineers, Inc., Atlanta, GA, pp. 581-586, Published: Jul. 1, 1999.

Mai, Q., U.S. Appl. No. 12/052,287, titled "Magnetic Field Process for Preventing Wax Separation in Petroleum," filed Mar. 20, 2008 (certified English translation attached).

International Search Report and Written Opinion dated Apr. 23, 2009 for PCT Application No. PCT/US2008/072137.

* cited by examiner

Phased Array Connect & Switch Timing Schematic

METHODS FOR REDUCING DEPOSITS IN PETROLEUM PIPES

CROSS-REFERENCE TO RELATED APPLICATIONS

This application is a division of U.S. patent application Ser. No. 12/185,604, filed Aug. 4, 2008, now U.S. Pat. No. 7,730, 899, titled "METHOD AND APPARATUS FOR REDUCING DEPOSITS IN PETROLEUM PIPES," which is a continuation-in-part of U.S. patent application Ser. No. 12/052, 287, filed Mar. 20, 2008, titled "MAGNETIC FIELD PROCESS FOR PREVENTING WAX SEPARATION IN PETROLEUM," now abandoned, which claims the benefit of Chinese Patent Application No. 200710038228.X, filed Mar. 20, 2007. Each of the foregoing applications is incorporated by reference in its entirety and made part of this specification.

BACKGROUND

1. Field

The present patent application generally relates to petroleum production and more particularly to methods and apparatus for preventing, reducing, or removing deposits in petroleum pipes or pumping rods of pumping units.

2. Description of Related Technology

The global oil extraction industry has always been troubled by wax (e.g., alkanes, also known as paraffins) and dirt deposits in oil well pipes. Wax deposit causes erosion and obstruction of the pump rods, while dirt deposit leads to accelerated wear of the pump rods, thereby leading to decreased oil production and even shut down of the production in order to remove the wax with chemicals, which in turn results in chemical pollution of the environment. Serious dirt deposits may even require washing the well with hot water. Moreover, existing mechanical scrapers are both time and labor intensive, and materials and energy consuming, while the results are often less than ideal.

In order to increase oil production, currently existing technologies utilize physical and chemical principles, such as electromagnetic fields and ultrasonic waves, to reduce dirt accumulation by activating easily segregated dirt molecules using corresponding inductors, but the results are generally not satisfactory. For example, Chinese Utility Model Patent No. 99250279.9, titled "An Apparatus for Removing Wax Deposits from Oil Wells," uses a windlass to place a cable connected to a pulse signal transmitter at the bottom of a well, and transforms the pulse signal into ultrasound using a transducer in order to remove the wax deposits in the well. However, this apparatus can only function if placed inside a crude oil pipe.

SUMMARY

In one embodiment, an apparatus for removing deposits from a petroleum flow line is provided. The apparatus can include a pipe that can be attached to a petroleum flow line. The pipe can have a pipe axis that defines a direction for fluid flow in the petroleum flow line. The apparatus can also include a first and a second field winding circumferentially disposed around the pipe, and an electric wave generator adapted to electrically communicate an electric wave to the first field winding and the second field winding. In response to the electric wave, the first field winding is adapted to produce a first magnetic field having a first magnetic axis and the second field winding is adapted to produce a second magnetic field having a second magnetic axis. The first magnetic axis can be noncollinear with respect to the second magnetic axis, and at least the first magnetic axis can be noncollinear with respect to the pipe axis.

An embodiment of an apparatus for reducing deposits in a petroleum pipe can include a field winding disposed adjacent a petroleum pipe that has a passageway for flow of a petroleum fluid. The field winding can be adapted to produce a magnetic field the extends into the passageway of the pipe. The apparatus can include an electric wave generator adapted to communicate an electric wave to the field winding such that in response to the electric wave the field winding produces the magnetic field. The electric wave can include a high frequency component, a low frequency component, and an ultralow frequency component. The high frequency component can include a high frequency in a range from approximately 25 kHz to approximately 65 kHz, the low frequency component can include a low frequency in a range from approximately 25 Hz to approximately 240 Hz, and the ultralow frequency component can include an ultralow frequency in a range from approximately 0.1 Hz to approximately 10 Hz. In some embodiments, at least one of the high frequency, the low frequency, and the ultralow frequency is selected based at least in part on the properties of the petroleum fluid that can flow in the petroleum pipe.

An embodiment of a method of reducing deposits in a petroleum pipe is provided. The method includes generating an electric wave comprising a high frequency component, a low frequency component, and an ultralow frequency component. The high frequency component may include a high frequency in a range from approximately 25 kHz to approximately 65 kHz, the low frequency component may include a low frequency in a range from approximately 25 Hz to approximately 240 Hz, and the ultralow frequency component may include an ultralow frequency in a range from approximately 0.1 Hz to approximately 10 Hz. The method further includes applying the electric wave to a plurality of field windings circumferentially disposed around a petroleum pipe while a petroleum fluid is flowing through the petroleum pipe.

In certain embodiments, an apparatus for resisting wax and dirt build up in an oil well includes an exciter comprising a plurality of segmented field windings, and an electric wave generator adapted for generating an electric wave and providing the electric wave to the plurality of field windings. The exciter may be mounted externally around a nonmagnetic pipe at a Christmas tree on a wellhead of the oil well, and the plurality of field windings can be adapted for producing a plurality of serially connected and continuously inverting magnetic poles upon application of the electric wave. The electric wave generator may be adapted for receiving an alternating current input, rectifying the alternating current input, and outputting, as the electric wave, a pulse current having wide spectrum high order harmonics and a pulse excited waveform that periodically changes in an ultralow frequency selected from 0.5-10 Hz.

In some embodiments, the exciter includes fifty segmented field windings or fewer. In some other embodiments, the plurality of field windings are connected with one another in any one of a series connection, parallel connection, and phased array connection so as to produce corresponding electromagnetic fields having different strengths and frequencies. In certain embodiments, the electric wave generator includes at least one bridge-type thyristor adapted for rectifying the alternating current input. In these embodiments, a conduction angle of the at least one bridge type thyristor is controlled by a trigger potential that periodically changes in the ultralow frequency selected from 0.5-10 Hz. In further embodiments, the pulse excited waveform outputted by the at least one bridge-type thyristor includes approximate square wave front edges.

In certain embodiments, the apparatus for resisting wax and dirt build up in an oil well additionally includes a temperature feedback controller adapted for controlling the electric wave generator based upon a representation of a temperature feedback from the exciter. In some embodiments, the apparatus for resisting wax and dirt build up in an oil well additionally includes a controller adapted for setting up at least one of magnetic field strength to be produced by the exciter, initial values of the electric wave generator, and the ultralow frequency.

Embodiments of the present invention may reduce petroleum viscosity and prevent paraffin wax and dirt from deposition in oil pipes, which eliminates or reduces the necessity of washing oil wells. Furthermore, embodiments of the present invention may reduce pumping resistance in oil pipes, reduce driving current provided to pumping units, and increase flow velocity of petroleum within oil pipes. All these may enhance petroleum production and transportation efficacy.

BRIEF DESCRIPTION OF THE DRAWINGS

The following drawings and the associated descriptions are provided to illustrate embodiments of the present disclosure and do not limit the scope of the claims.

DETAILED DESCRIPTION OF EMBODIMENTS

Figure 1:
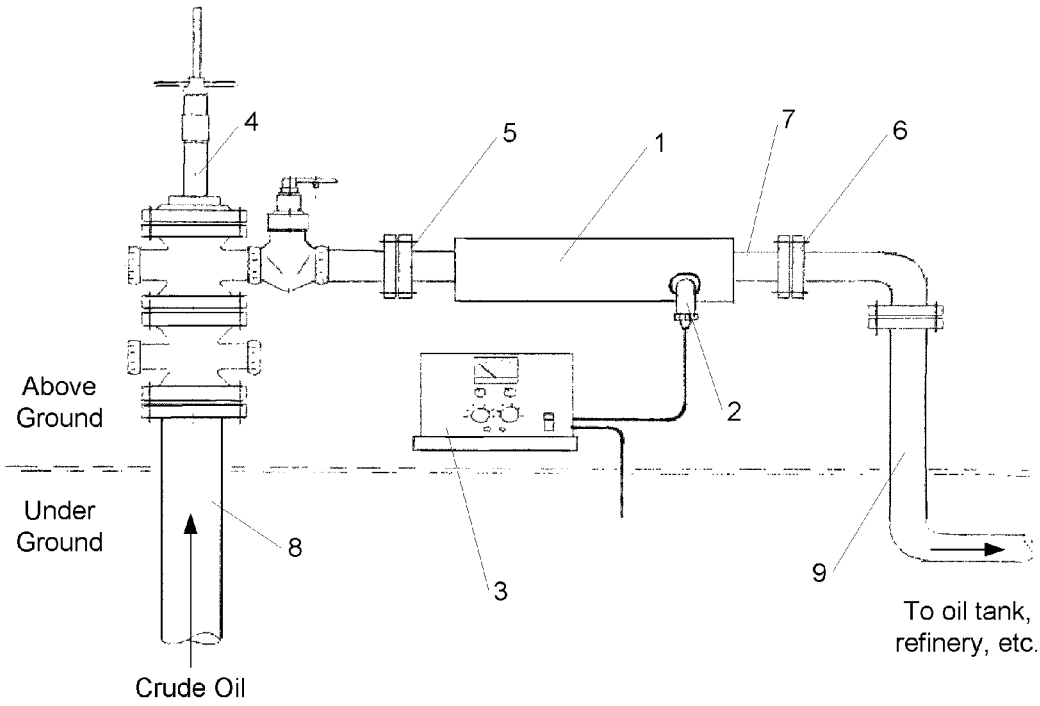
FIG. 1 schematically illustrates an embodiment of an apparatus for reducing deposits in which an exciter is mounted on an outlet pipe of a Christmas tree at an oil well.

The following detailed description is directed to certain embodiments of the disclosure. However, various embodiments of the disclosure can be embodied in a multitude of different ways, for example, as defined and covered by the claims. The embodiments described herein may be embodied in a wide variety of forms and any specific structure, function, or both being disclosed herein is merely representative. Based on the teachings herein one skilled in the art should appreciate that an embodiment may be implemented independently of any other embodiments and that two or more of these embodiments may be combined in various ways. For example, an apparatus may be implemented or a method may be practiced using any number of the embodiments set forth herein. In addition, such an apparatus may be implemented or such a method may be practiced using other structure, functionality, or structure and functionality in addition to or other than one or more of the embodiments set forth herein.

Although certain embodiments are described in the illustrative context of reducing deposits in a petroleum pipe, a person of ordinary skill will recognize that the apparatus and methods disclosed herein may be used to reduce deposits and remove contaminants in conduits adapted to carry other fluids (e.g., water). For example, in certain embodiments, the disclosed systems and methods may be used for descaling pipes, flow lines, chillers, heat exchangers, and so forth.

An embodiment of an apparatus for reducing deposits in a pipe (such as, e.g., a petroleum pipe) includes an exciter and an electric wave generator. The exciter includes a plurality of field windings (also referred to in some embodiments as segmented field windings) that can be externally mounted to a length of the pipe. For example, the field windings can substantially surround a length of a petroleum pipe. The petroleum pipe can be, for example, a portion of an oil pipe for outputting crude oil from an oil well or a portion of an oil pipeline for transporting the crude oil. In some embodiments, the exciter is externally mounted to a length of the pipe that is substantially non-magnetic. A possible advantage of some embodiments of the disclosed apparatus is that the apparatus can be externally mounted on a portion of the pipe that is readily accessible (e.g., above ground).

The electric wave generator includes circuits for generating an electric wave. The electric wave generator provides the generated electric wave to the field windings of the exciter. In some embodiments, the electric wave includes several wave components such as, for example, a high frequency alternating wave, a low frequency pulse wave, and/or an ultralow frequency rectangular pulse wave having an approximately square wave front edge.

In one embodiment, upon application of the electric wave, the field windings produce a magnetic field at least within a portion of the pipe. The produced magnetic field may have a serially changed, erratic, twist axial angle with respect to an axis of the petroleum pipe. In one embodiment, the produced magnetic field includes high frequency alternating magnetic fields. As is known from Maxwell's equations, the time-varying magnetic field in the pipe may induce an electric field (e.g., via Faraday's principle). In such embodiments, the electric field and/or the magnetic field (which are components of the electromagnetic field) may provide resonance excitation energies to particles in the fluids in the pipe (e.g., petroleum and mud water). It is possible (although not required) that the resonance excitation energies cause the particles to take a longer time to drop to lower energy levels prior to being segregated from the flow within the petroleum pipes. In one embodiment, the produced magnetic field includes low frequency magnetic fields that may provide energies to separate wax molecules or dirt clusters that have been segregated from the petroleum and mud water so that the wax molecules or dirt clusters have a lower probability of depositing on inner surfaces of petroleum pipes or outer surfaces of pumping rods. In one embodiment, the produced magnetic field includes ultralow frequency magnetic fields that may provide micro-surge hydraulic effects to dissolve wax molecules or dirt clusters that have already deposited on inner surfaces of the petroleum pipes or outer surfaces of pumping rods. In other embodiments, other effects may contribute to the reduction or prevention of deposits in the pipe.

FIG. 1 schematically illustrates an embodiment of an apparatus for reducing (or preventing) deposits in a pipe. As illustrated in the embodiment shown in FIG. 1, an exciter 1 is externally disposed around a pipe 7. In this example, the pipe 7 is connected, at one of its ends, with an outlet branch of a Christmas tree 4. The pipe 7 is also connected, at its other end, with an oil pipeline 9. Flanges 5 and 6 can be used to connect the outlet branch of the Christmas tree 4 and the pipeline 9, respectively, to the ends of the pipe 7. In other examples, the pipe 7 can be connected to other fluid connectors, flow apparatus, pumps, etc. In other embodiments, the exciter 1 can be disposed around portions of other pipes than the pipe 7 shown in FIG. 1. For example, the exciter 1 can be disposed around a portion of the oil pipeline 9, the oil pipe 8, or some other pipe or fitting.

The Christmas tree 4 is an assembly comprising valves, spools and fittings for an oil pipe 8 secured within an oil well. The Christmas tree 4 functions to prevent the release of oil from the oil pipe 8 into the environment and to direct and control the flow of formation fluids from the oil well. As illustrated in FIG. 1, the crude oil is brought to the ground surface within the oil pipe 8 by underground pressure and collected by the Christmas tree 4. The crude oil thus produced by the Christmas tree 4 subsequently flows through the pipe 7 and into the oil pipeline 9 for transporting, for example, to an oil tank, a refinery, or other oil facility.

Although FIG. 1 illustrates use of the Christmas tree 4 for producing the oil from the well, any lifting mechanism, such as a pumping unit, an artificial lifting method, water injection, etc., can be utilized to produce the crude oil after pressure in the oil well has depleted.

In the embodiment illustrated in FIG. 1, the exciter 1 is electrically connected with an electric wave generator 3 through a plug 2. In one embodiment, the plug 2 includes one or more (e.g., 20) cores to provide electrical connections to components of the exciter 1. The electric wave generator 3 generates an electric wave and communicates the electric wave to the exciter 1 via the plug 2.

Figure 2:
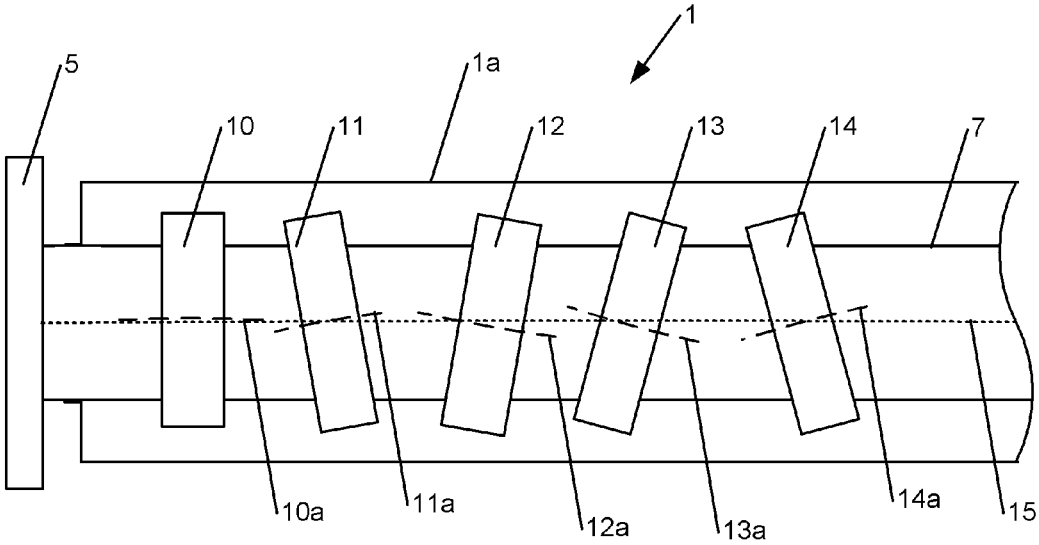
FIG. 2 is schematically illustrates an example of a winding arrangement in an embodiment of an exciter.

FIG. 2 schematically illustrates an example of a winding arrangement in an embodiment of the exciter 1. The exciter 1 includes at least two field windings. In some embodiments, the number of field windings ranges from two (2) to fifty (50). In other embodiments, the number of field windings can be greater then fifty (50).

In the embodiment illustrated in FIG. 2, the exciter 1 includes five field windings 10, 11, 12, 13, 14. One or more of the field windings 10, 11, 12, 13, 14 can be spaced from one another longitudinally along the pipe 7. The exciter 1 also includes a protection housing la that encloses a length of the pipe 7, the field windings 10, 11, 12, 13, 14, and corresponding electrical cables and connections (not illustrated). The protection housing 1*a* can include a magnetic material (e.g., a high permeability metal) to shield the exterior regions of the exciter 1 from magnetic fields generated in the windings 10-14. In one embodiment, the pipe 7 is above the ground and is made of nonmagnetic material. In one embodiment, the pipe 7 has a length in a range from about fifty to one hundred centimeters and can be substantially surrounded by two to about fifty field windings. In one embodiment, seven windings are used.

In one embodiment, the pipe 7 is eighty (80) centimeters long and is made of nonmagnetic material. Cables can be used to connect the field windings 10, 11, 12, 13, 14 to the plug 2 which may be removably attached to an external surface of the housing 1*a*.

In the embodiment illustrated in FIG. 2, the field windings 10, 11, 12, 13, 14 are externally mounted around a length of the pipe 7, which has a pipe axis 15. In some embodiments, the field windings can be adapted for producing two magnetic poles (e.g., North (N) and South (S)) upon application of an electric wave generated by the electric wave generator 3. Each of the field windings can generate a magnetic field having a magnetic axis. For example, as shown using dot-dash lines in FIG. 2, the field windings 10, 11, 12, 13, and 14 each have a respective magnetic axis 10*a*, 11*a*, 12*a*, 13*a*, and 14*a*. Accordingly, the plurality of field windings includes a plurality of magnetic axes.

The field windings of the exciter 1 can be adapted so that their respective magnetic axes form a variety of magnetic configurations. For example, in one embodiment, the magnetic axis of one field winding is nonlinear with the magnetic axes of at least one other field winding. The magnetic axes of one or more of the field windings can be noncollinear with respect to the pipe axis 15. In another embodiment, the magnetic axis of one field winding and the magnetic axis of another field winding are substantially parallel to each other but are spatially displaced from each other. In another embodiment, the magnetic axis of one field winding and the magnetic axis of another field winding (or the pipe axis 15) are in substantially the same plane but intersect to define an angle therebetween. In another embodiment, the magnetic axis of one field winding and the magnetic axis of another field winding are displaced from each other and form an angle with respect to each other (e.g., the respective magnetic axes can lie in different planes). The angle formed between the magnetic axes of field windings can include 0 degrees (e.g., the two magnetic axes are parallel). In another embodiment, the magnetic axis of one field winding is in a different plane from the magnetic axis of another field winding. Examples of possible arrangements of the field windings in the exciter 1 are shown and described with reference to FIGS. 3 to 9.

Figure 3:
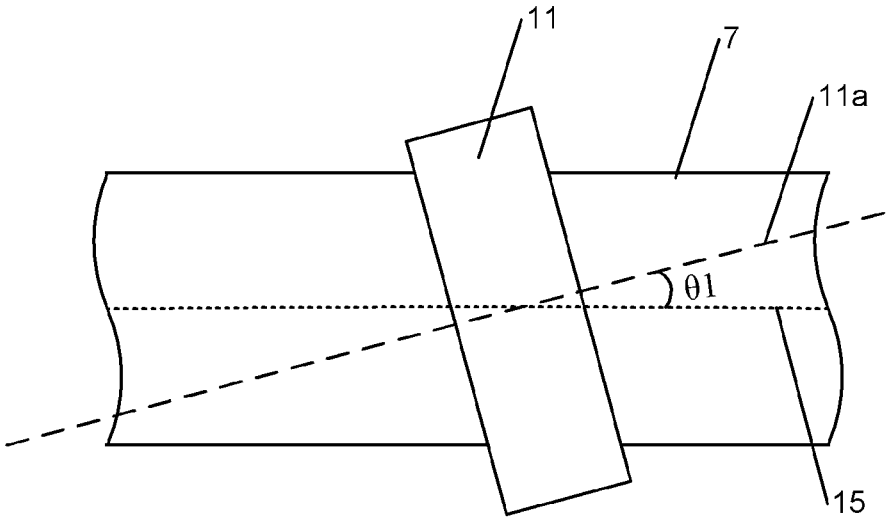
FIGS. 3, 4 and 5 schematically illustrates examples of a relationship between one of the field windings and the pipe illustrated in FIG. 2.

FIG. 3 is a top view schematically illustrating an example of the relationship between one of the field windings, e.g., field winding 11, and the pipe 7. The magnetic axis 11*a* of the field winding 11 is illustrated by a dot-dash line, and the axis 15 of the pipe 7 is illustrated by a dotted line. In the example illustrated in the top view of FIG. 3, the field winding 11 is rotated (relative to the plane shown in FIG. 3) by an angle θ1 with respect to the pipe axis 15. In some embodiments, the angle θ1 is in a range from approximately 0 degrees to approximately 30 degrees. In other embodiments, the angle θ1 is greater than approximately 30 degrees.

Figure 4:
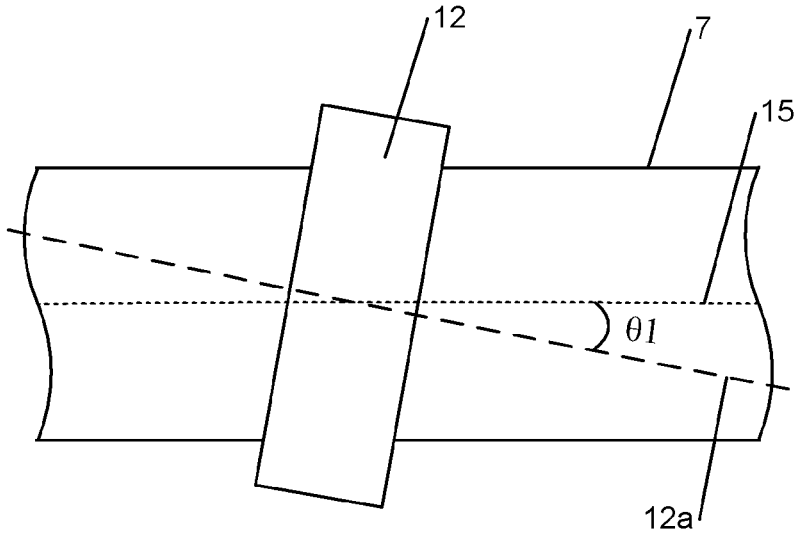

FIG. 4 is a top view schematically illustrating another example of the relationship between field winding 12 with magnetic axis 12*a* and the pipe 7. In this example, the angle θ1 is rotated in an opposite direction as compared to the example shown in FIG. 3. In some embodiments of the example shown in FIG. 4, the angle θ1 is in a range from approximately 0 degrees to approximately 30 degrees. In other embodiments, the angle θ1 is greater than approximately 30 degrees.

Figure 5:
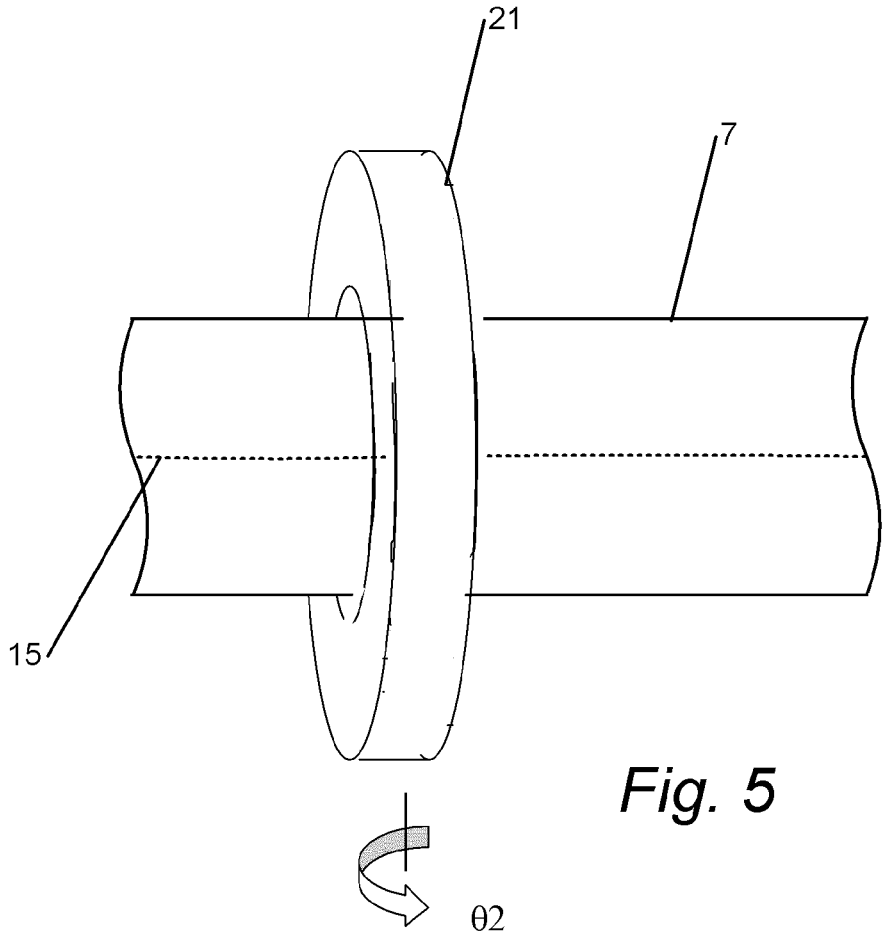

FIG. 5 is a top view illustrating another example of the relationship between one of the field windings, e.g., field winding 21 (not illustrated in FIG. 2), and the pipe 7. In this example, the field winding 21 is tilted (relative to the plane of FIG. 4) by an angle θ2. Therefore, the magnetic axis of the field winding 21 forms an angle θ2 with respect to the axis 15 of the pipe 7. In some embodiments, the angle θ2 is in a range from approximately 0 degrees to approximately 30 degrees. In other embodiments, the angle θ2 is greater than approximately 30 degrees. As can be seen by comparing FIGS. 3, 4 and FIG. 5, the rotation axis of the field winding 11 is perpendicular to the tilt axis of the field winding 21. In certain embodiments, a field winding can be rotated by a rotation axis θ1 about a first direction (see, e.g., FIGS. 3, 4) as well as tilted by a tilt axis θ2 about a second direction (see, e.g., FIG. 5). The first direction can be perpendicular to (e.g., orthogonal to) the second direction. In various embodiments, one or both of the angles θ1 and θ2 can be in the range from approximately 0 degrees to approximately 30 degrees. Other angles can be used in other embodiments.

Figure 6:
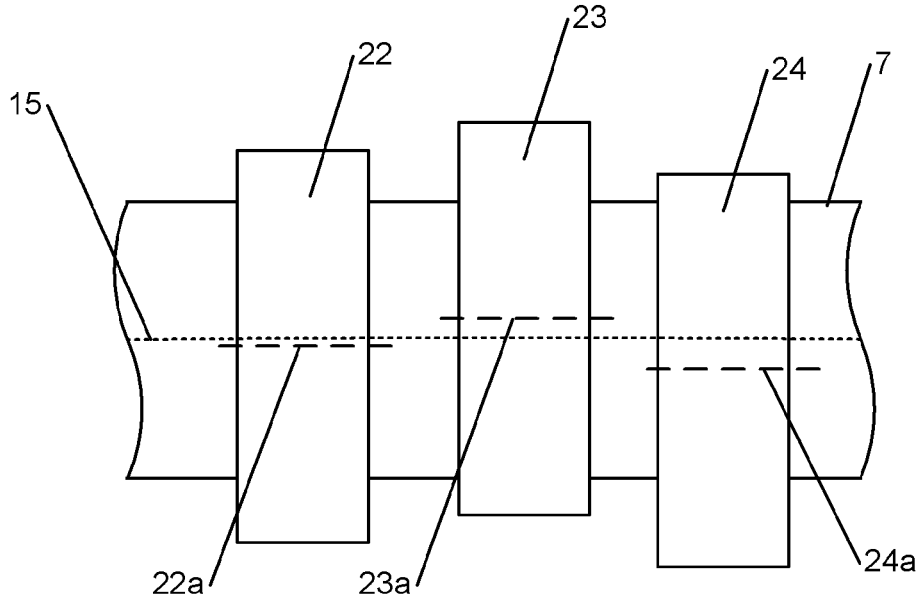
FIGS. 6, 7, 8 and 9 schematically illustrate other examples of possible winding arrangements in embodiments of an exciter.
Figure 7:
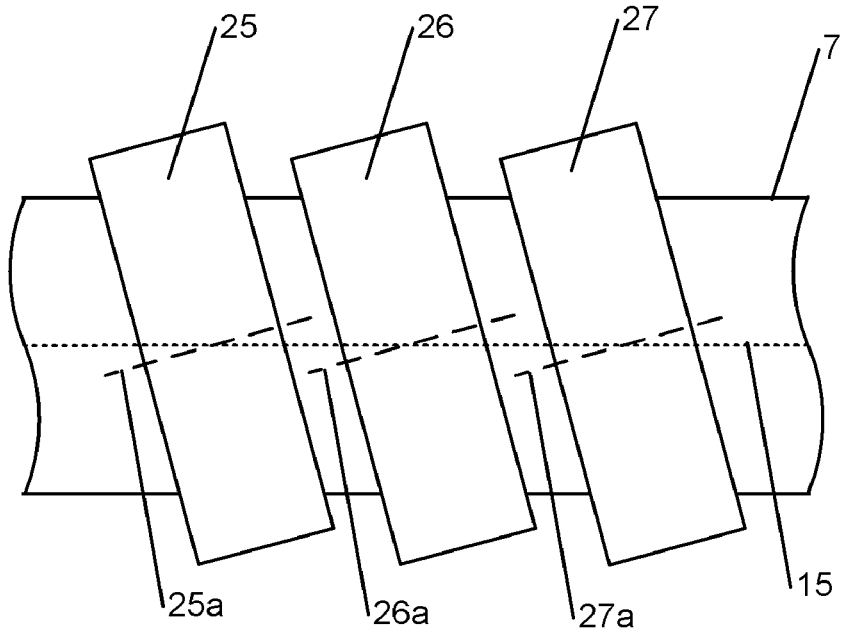
Figure 8:
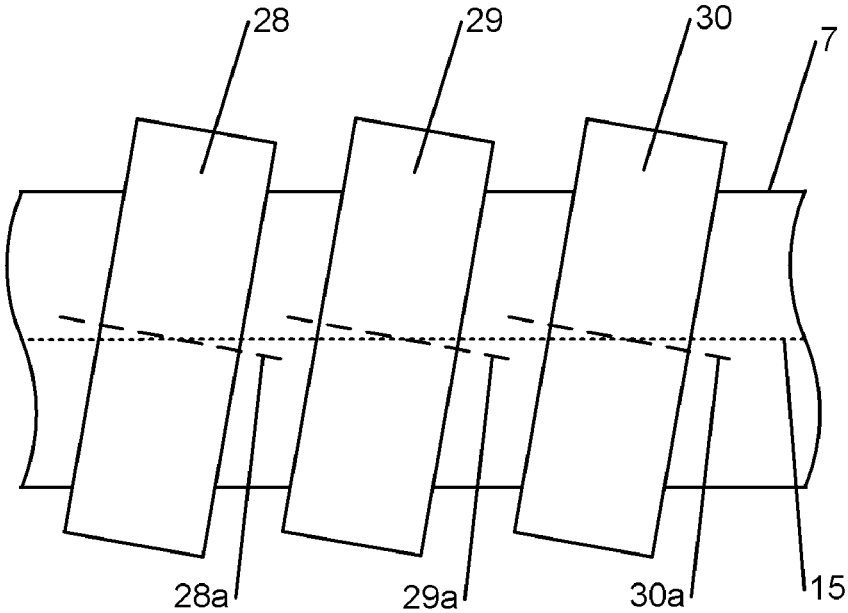

FIGS. 6, 7 and 8 are top views schematically illustrating three other examples of possible winding arrangements in the exciter 1. In FIG. 6, field windings 22, 23, and 24 have respective magnetic axes 22*a*, 23*a*, and 24*a*. In this example, the magnetic axes 22*a*-24*a* are substantially parallel to each other and substantially parallel to the pipe axis 15. The rotation and tilt angles θ1 and θ2 for each of the field windings 22-24 are small (near 0 degrees). The magnetic axes 22*a*-24*a* are displaced from the pipe axis 15 by varying amounts, for example, the magnetic axis 22*a* is displaced less from the pipe axis 15 than the magnetic axis 24*a*. In this example, the magnetic axis 23*a* is displaced above the pipe axis 15 (in the plane of FIG. 6), and the magnetic axes 22*a* and 24*a* are displaced below the pipe axis 15 (in the plane of FIG. 6). Other displacement amounts (and directions relative to the pipe axis 15) can be used in other embodiments.

FIGS. 7 and 8 are top views schematically illustrating field windings 25, 26 and 27 (with respective magnetic axes 25*a*, 26*a*, and 27*a*) and field windings 28, 29 and 30 (with respective magnetic axes 28*a*, 29*a*, and 30*a*). In each of these examples, the magnetic axes are substantially parallel to each other but form angles with respect to the pipe axis 15. In the example shown in FIG. 7, the magnetic axes 25*a*-27*a* are rotated counterclockwise with respect to the pipe axis 15 and in the example shown in FIG. 8, the magnetic axes 28*a*-30*a* are rotated clockwise with respect to the pipe axis 15.

Figure 9:
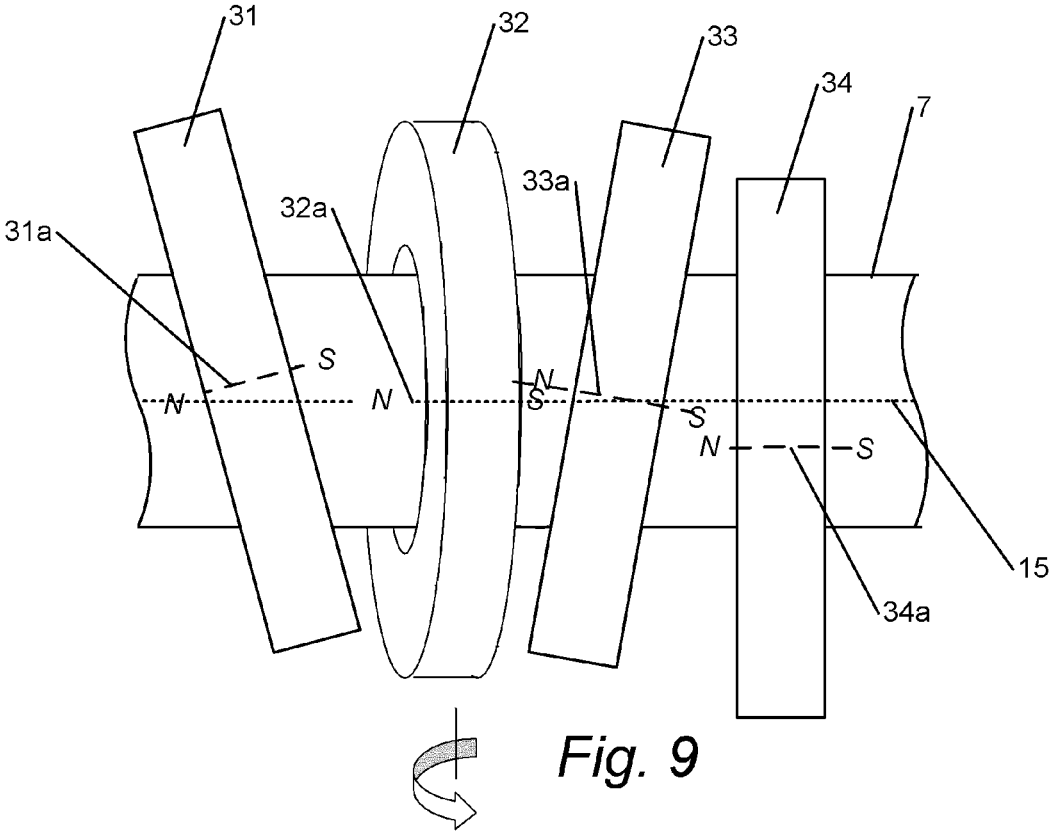

FIG. 9 is a top view schematically illustrating another example of a possible winding arrangement of the exciter 1. The exciter 1 includes field windings 31, 32, 33, and 34 with respective magnetic axes 31*a*, 32*a*, 33*a*, and 34*a*. In this example, the magnetic axis 31*a* is rotated clockwise and displaced from the pipe axis 15. In this example, the magnetic axis 32*a* is tilted (and may be displaced from) the pipe axis 15. In this example, the magnetic axis 33*a* is rotated counterclockwise from the pipe axis 15. In this example, the magnetic axis 34*a* is substantially parallel to but displaced from the pipe axis 15.

The example configurations of the field windings and magnetic axes shown in FIGS. 3-9 are intended to be illustrative and not to limit the types of magnetic field arrangements usable in the exciters described herein. For example, different numbers of field windings may be used than are shown in FIGS. 3-9. The spatial separation between field windings may be different than shown. A magnetic axis of any field winding may have a different rotation angle, tilt angle, and/or displacement from the pipe axis 15 than shown in FIGS. 3-9. Many variations are possible.

The field windings of the exciter can be electrically connected in any suitable electrical configuration. For example, the windings can be connected in series, in parallel, or in a phased array in order to provide different field effects for different crude oil compounds. In some embodiments, the phased array connection can be similar to the connection of phased array radars or phased array antennas. For example, the field windings shown in FIG. 9 can be connected as a phased array. Examples of switch and timing diagrams for an embodiment of a five winding exciter connected as a phased array are described below with reference to FIG. 11B.

In some embodiments, the field windings produce two magnetic poles upon application of the electric wave provided by the electric wave generator 3. Accordingly, the field windings of the exciter 1, if applied with the electric wave generated by the electric wave generator 3, collectively produce a resultant magnetic field that advantageously can extend at least into the pipe 7. As will be described below with respect to FIGS. 11 and 11A, 11B, the elective wave generated by the electric wave generator 3 may include alternating components. In some such embodiments, the magnetic poles produced by the field windings can alternate in response to the electric wave supplied by the generator 3. Consequently, in certain such embodiments, as fluid (e.g., oil and/or mud water) flows through the pipe 7, the fluid experiences a resultant magnetic field geometry that may have serially changed magnetic poles and field lines that may have portions that are substantially non-parallel and/or substantially non-perpendicular to the pipe axis 15. For example, FIG. 9 schematically illustrates a possible sequence of North (N) and South (S) magnetic poles for each of the field windings 31-34 at a particular time. In this example, fluid flowing through the pipe 7 would experience a sequence NSNSNSNS of magnetic poles. In other embodiments, the polarity of one or more of the magnetic axes 31*a*-34*a* may be different than shown in FIG. 9. For example, the polarity of a magnetic axis may be changed by changing the wiring connections of the field windings and/or by changing the direction of the current (and/or voltage) applied to particular field windings. In some embodiments, the electric wave is a direct current that changes amplitude as a function of time. In some embodiments, the electric wave may include an alternating current component.

The resultant magnetic field produced by the windings 31-34 shown in FIG. 9 can have a field geometry that includes magnetic field lines that are not substantially parallel to and/or not substantially perpendicular to the pipe axis 15. For example, in some exciter embodiments comprising rotated, tilted, and/or displaced field windings, the resultant magnetic field lines include portions that are curved or wavy relative to the pipe axis 15. In some such embodiments, the magnetic axis of at least one field winding and the pipe axis 15 are noncollinear. Also, in some embodiments, the magnetic axis of a first winding and the magnetic axis of a second winding are noncollinear. Consequently, fluid flowing through such exciter embodiments may experience a magnetic field whose magnitude and/or direction (relative to the fluid) appears to vary spatially and/or temporally as the fluid passes through the exciter 1.

In some embodiments, the electric wave is communicated to the field windings of the exciter as a direct current (DC) in which the direction of the current does not change with time. The amplitude of the DC current can vary in time as discussed below. The magnetic poles (termed DC magnetic poles) produced by one or more field windings upon application of the direct current may be selected to be in conformity with Earth's magnetic field at the location of the exciter. For example, for an oil well that is located in the Northern Hemisphere, one DC magnetic pole closer to the Christmas tree 4 is a North magnetic pole; another DC magnetic pole farther from the Christmas tree 4 is a South magnetic pole. For an oil well that is located in the Southern Hemisphere, one DC magnetic pole closer to the Christmas tree 4 is a South magnetic pole; another DC magnetic pole farther from the Christmas tree 4 is a North magnetic pole. In such arrangements of DC magnetic poles of the field windings, the magnetic fields produced by the field windings may be propagated along other pipes in the system if the pipes are formed from a magnetic material (e.g., a ferromagnetic material such as iron, cobalt, etc.). For example, as illustrated in FIG. 1, the magnetic field produced by the exciter 1 may propagate to the pipe 8 into deeper portions of the oil well, which advantageously may reduce (or prevent) or remove deposits in deeper portions of the oil pipe 8. In other embodiments, the magnetic field produced by the exciter may propagate to other pipes, connections, fittings, etc. that are formed from a suitably magnetic material.

Figure 10:
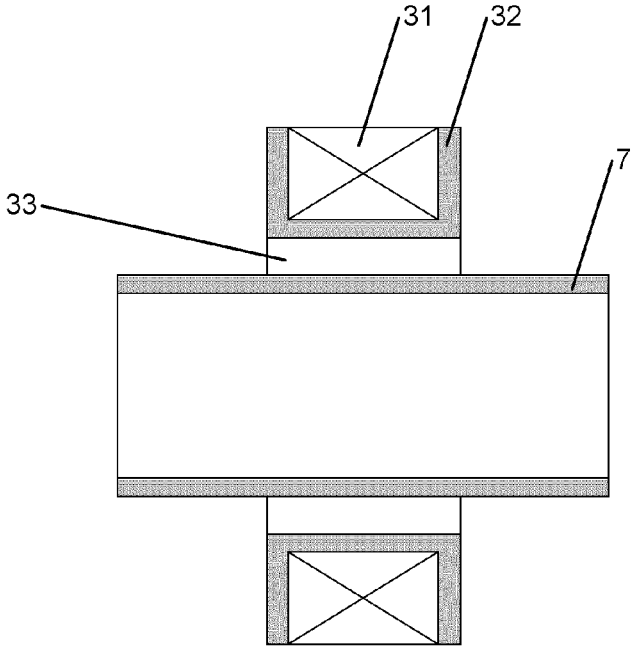
FIG. 10 is a cross-section view that schematically illustrates an embodiment of a winding frame for mounting a field winding circumferentially around a pipe.

FIG. 10 is a cross-section view schematically illustrating a winding frame 32 for mounting a field winding 31 externally around a pipe 7. As illustrated in FIG. 10, the field winding 31 can be coiled in the winding frame 32. The pipe 7 passes through an opening 33 of the winding frame 32. The winding frame 32 can be rotated, tilted, and/or displaced with respect to the pipe 7 to provide desired arrangements of the field windings and magnetic axes. The winding frame 32 can be securely attached to the outer surface of the pipe 7. In some embodiments, the winding frame 32 is adjustable relative to the pipe 7 so that the arrangement of the frame 32 and the pipe 7 can be changed as desired. In some embodiments, a first, inner winding frame can be nested within at least one second, outer winding frame.

Figure 11:
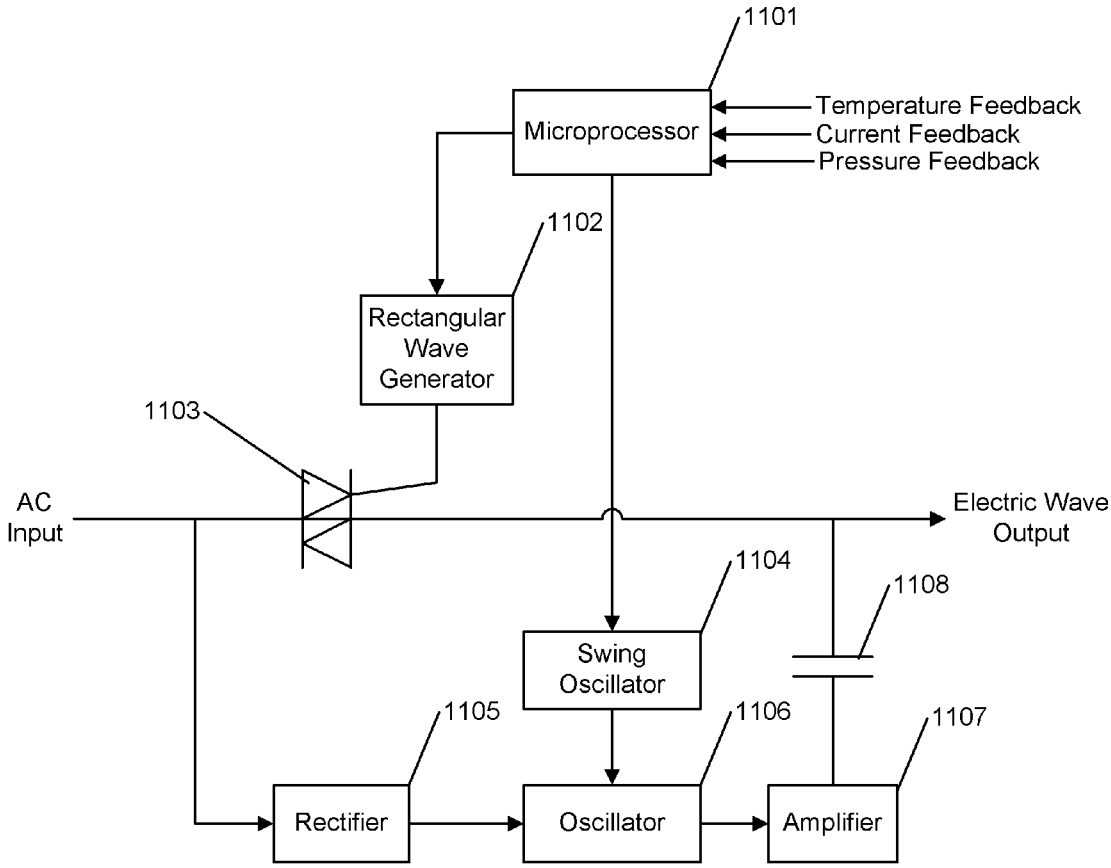
FIG. 11 is a schematic diagram illustrating an example of an electric wave generator.

FIG. 11 is a schematic diagram illustrating an example of the electric wave generator 3. In this embodiment, the electric wave generator 3 includes a microprocessor 1101, a wave generator 1102, a rectifying circuit 1103, a swing oscillator 1104, a rectifier 1105, an oscillator 1106, an amplifier 1107, and a capacitor 1108. In other embodiments, additional and/or different components can be used, and some or all of the functionality of the components shown in FIG. 11 can be integrated. Many variations are possible.

In the embodiment illustrated in FIG. 11, the rectifier 1105 receives an alternating current (AC). In one embodiment, the alternating current is 50 Hz, 220 VAC. In another embodiment, the alternating current is 60 Hz, 110 VAC. Alternating currents of other frequencies and other voltages are used in other embodiments. For example, 660 VAC is used in one embodiment.

The rectifier 1105 converts the alternating current into a direct current. The rectifier 1105 can include a nonlinear circuit component that allows more current to flow in one direction than in the other. In one example, a full-wave rectifier 1105 is utilized. In another example, a half-wave rectifier 1105 is utilized.

The oscillator 1106 can include an electronic circuit that converts energy from a direct current source into a periodically varying electrical output. In one embodiment, the high frequency alternating wave output by the oscillator 1106 includes a sinusoidal wave. In some embodiments, the oscillator 1106 converts the direct current from the rectifier 1105 into a high frequency alternating wave. In one embodiment, the high frequency is selected in a range from approximately 25 kHz to approximately 65 kHz. The choice of the high frequency can be chosen based on the fact that the wax at different oil fields may possibly have different geology. For example, the value of the high frequency may be selected based upon experiments at and/or statistical data from an oil field in order to better conform to the wax geology at the particular oil field.

The amplifier 1107 can include a device capable of increasing the power level of a physical quantity that is varying with time, without substantially distorting the wave shape of the quantity. In the embodiment illustrated in FIG. 11, the amplifier 1107 amplifies the power level of the high frequency alternating wave output by the oscillator 1106. In some embodiments, the amplitude of the high frequency wave (without load) may be in a range from approximately 15V to approximately 25V, peak to peak. When connected to a load (e.g., the field windings), the amplitude of the high frequency wave may be in a range from approximately 2V to approximately 4V (in an example exciter having 5 windings connected in series). In some cases, inductance of the field windings may effect material properties, which can modify the parameters of the electric wave (e.g., voltage and/or current).

In some embodiments, the output terminal of the amplifier 1107 is coupled to an output terminal of the electric wave generator 3 using the capacitor 1108. In some embodiments, the capacitor 1108 outputs the high frequency alternating wave to an output terminal of the electric wave generator 3 as a first component of the electric wave generated by the electric wave generator 3. As described below, in some embodiments, the electric wave may also include other components and may be termed a composite wave.

In certain embodiments, the high frequency alternating wave, when applied to the field windings of the exciter 1, cause the field windings to produce high frequency alternating electromagnetic fields. The high frequency alternating electromagnetic fields may, in some cases, provide resonance excitation energies to particles in the petroleum and mud water in the pipe 7 (or other pipes fluidly connected thereto). Without subscribing to or requiring any particular theory, the resonance excitation energies provided to the particles may inhibit (or prevent) the segregation and/or deposition of wax molecules and/or dirt in the petroleum (and/or mud water). For example, during the process of producing petroleum from an oil well, the temperature and pressure of the petroleum drop as the petroleum is pumped to the surface. The excitation levels of wax molecules or dirt in the petroleum generally decrease as the temperature and/or pressure decrease. At lower excitation levels, the wax (and/or dirt) may form wax molecules (and/or dirt clusters). By applying the high frequency alternating magnetic fields produced by the exciter, particles in the petroleum and/or mud water may receive excitation energy which tends to increase their excitation levels relative to the case where no high frequency alternating magnetic fields are applied. Accordingly, one possible (but not required) reason for the efficacy of the disclosed apparatus and methods is that the wax molecules and/or dirt may be inhibited from being segregated from the petroleum and/or mud water. Accordingly, oil wells utilizing embodiments of the exciter may experience fewer deposits on the pipe surfaces and other components in contact with the petroleum. Although this is one possible physical mechanism that may occur in some cases, additional and/or different physical mechanisms may be responsible (at least in part) for reducing the deposits in pipes utilizing embodiments of the disclosed apparatus and methods.

Embodiments of the electric wave generator 3 may include additional components besides the first, high-frequency component. For example, one or more additional components can be used to modulate the high frequency alternating wave and/or produce frequency components at lower frequencies. For example, in some embodiments, the generator 3 also includes a swing oscillator 1104, which can be used for generating a low frequency time-varying wave, which can be output to the oscillator 1106. In some embodiments, the low frequency time-varying wave includes a sinusoidal wave or a triangular wave. In response to being modulated by the low frequency time-varying wave from the swing oscillator 1104, the oscillator 1106 alternately increases and decreases the frequency of the high frequency alternating wave by an amount corresponding to the frequency of the low frequency time-varying wave. In one embodiment, the frequency of the low frequency time varying wave is sinusoidal with a frequency in a range from approximately 0 Hz to approximately 10 kHz. In one embodiment, the oscillator 1106 alternately increases and decreases (e.g., modulates) the frequency of the high frequency alternating wave (which in one case is 40 kHz)

by approximately ±5 kHz. Because it may be impractical to determine a high frequency such that the high frequency alternating wave substantially conforms to the wax geology of a particular oil field, by alternately increasing and decreasing the high frequency of the high frequency alternating wave, the likelihood of applying a suitable frequency to the wax molecules (and/or or dirt) in the petroleum and/or mud water at the particular oil field can be increased.

In certain embodiments, the electric wave generator 3 can include the rectifying circuit 1103. In certain such embodiments, the rectifying circuit 1103 can include at least one thyristor. In some embodiments, the rectifying circuit 1103 can include one or more transistors, MOSFETs, IGBTs, TRIACs, silicon controlled rectifiers (SCRs), diodes, etc. In some embodiments, the rectifying circuit 1103 can be used to convert the AC input into a low frequency pulse wave that is communicated to the output terminal of the electric wave generator 3 as a second component of the electric wave. In one embodiment, the thyristor is controlled by an optical beam (e.g., a light triggered thyristor or a light-activated silicon controlled rectifier). In one embodiment, the rectifying circuit 1103 includes a full-wave two-way thyristor. In some embodiments, the low frequency is in a range from approximately 25 Hz to approximately 240 Hz. For example, in one embodiment, if the AC input is 50 Hz, the low frequency pulse wave output by the rectifying circuit 1103 can be approximately 100 Hz. In some embodiments, with an input voltage of 220 VAC at 50 Hz, the amplitude of the low frequency wave (without load) may be in a range from approximately 50V to approximately 100 V. In another embodiment, if the AC input is approximately 60 Hz, the low frequency pulse wave output by the rectifying circuit 1103 may be approximately 120 Hz. With an input voltage of 240 VAC, the amplitude of the low frequency wave may be in a range from approximately 55 V to approximately 110 V (without load) in some cases. In the presence of load (e.g., when connected to the field windings), the amplitude of the low frequency wave may be approximately 20 V to approximately 60 V (in an example with 5 windings connected in series). In other embodiments, frequency dividers and/or frequency multipliers are utilized to decrease and/or increase, respectively, the frequency of the AC input current and/or the frequency of the low frequency pulse wave. In some implementations, transformers can be used to increase the input voltage to hundreds or thousands of volts, depending on the wax properties at the particular oil field.

In the embodiment illustrated in FIG. 11, the output terminal of the rectifying circuit 1103 and the output terminal of the amplifier 1107 are electrically isolated by the capacitor 1108. Consequently, the direct current component in the output of the rectifying circuit 1103 cannot pass the capacitor 1108. Therefore, in this embodiment, the rectifier 1105, the oscillator 1106, the amplifier 1107, and the swing oscillator 1104 are substantially protected from being damaged by a high-amperage current output by the rectifying circuit 1103. The direct current output by the rectifying circuit 1103 may be from several amperes to as high as several hundred amperes depending upon, for example, different field winding arrangements.

The second, low-frequency component of the electric wave can cause the field windings in the exciter to produce low frequency magnetic fields. Without subscribing to or requiring a particular theory, it may be possible in some cases for the low frequency magnetic fields to provide energies to wax molecules or dirt clusters that have already been segregated from the petroleum and mud water, thereby reducing the likelihood that (or preventing) smaller wax molecule or dirt clusters from growing into larger wax molecule or dirt clusters. In some cases, it may be possible that the low frequency magnetic fields may also squeeze and/or rub the wax molecule or dirt clusters (or other particulates or bumps) that are floating in the flow and have not deposited onto inner surfaces of the petroleum pipes or onto outer surfaces of pumping rods. The squeezing and rubbing may dissolve and/or reduce the size of wax molecule or dirt clusters. Consequently, the wax molecule or dirt clusters that have been segregated from the petroleum and mud water may have a lower probability of growing into bigger clusters or bumps and depositing onto inner surfaces of the petroleum pipes or outer surfaces of pumping rods. Additional and/or different physical processes may (at least in part) reduce the deposits in other cases.

In some embodiments, the electric wave generator 3 also includes a rectangular wave generator 1102. The rectangular wave generator 1102 can be used to generate an ultralow frequency rectangular wave and communicate the ultralow frequency rectangular wave to a thyristor in the rectifying circuit 1103. In some embodiments, the ultralow pulse frequency is selected to be in a range from approximately 0.1 Hz to approximately 10 Hz. The ultralow frequency rectangular wave can be utilized to modulate the thyristor, for example, by switch-modulation in which a conduction angle of the thyristor is controlled. Accordingly, in such embodiments, the thyristor is turned on and off at various phase angles of the low frequency pulse wave depending upon the amplitude (and/or phase) of the ultralow frequency rectangular wave. Therefore, in certain such embodiments, the thyristor outputs ultralow frequency pulses that approximate a square wave front edge as a third component of the electric wave. In other embodiments, the wave generator 1102 can produce waveform shapes that are different from rectangular such as, for example, triangular waves, sawtooth waves, sinusoidal waves, pulse trains, and so forth. The waveform shape produced by the wave generator 1102 can, but need not be, periodic in time. In other embodiments, other methods can be used to modulate the thyristor such as, for example, phase-modulation and/or amplitude-modulation.

The third, ultralow-frequency component of the electric wave can cause the field windings in the exciter to produce ultralow frequency pulse magnetic fields. Without subscribing to or requiring a particular theory, it may be possible in some cases for the ultralow frequency pulse magnetic fields to provide a micro-surge hydraulic effect to magnetized particles in the flow of petroleum and mud water. The distribution of the magnetized particles may not be uniform in the flow, which may cause wriggling motions of the magnetized particles in the flow, which may achieve a magnetic equilibrium in the flow. The wriggling motions of magnetized particles may help to dissolve wax molecule or dirt clusters that have deposited on inner surfaces of the petroleum pipes or outer surfaces of pumping rods. These effects are collectively referred to herein as "ultralow frequency micro-surge hydraulic effects." In some cases, the viscosity of the petroleum flow may impede rapid reorganization of the magnetized particles in the flow to achieve magnetic equilibrium, which may increase the disordered wriggling motions of the magnetized particles. The wriggling motion of magnetized particles may also result in surging motions of the magnetized particles. Along with the flow of the petroleum and mud water, the ultralow frequency micro-surge hydraulic effect may be propagated to substantial distances in the petroleum pipes, in some implementations. In some cases, the ultralow frequency micro-surge hydraulic effect may be propagated by way of a hydraulic press that can effectively push, rub, and/or dissolve wax molecules, dirt clusters, and/or bumps that have deposited on inner surfaces of the petroleum pipes or outer surfaces of pumping rods. The ultralow frequency micro-surge hydraulic effect may be more effective with ultralow frequencies than with higher frequencies, because high frequency motions of particles in the flow of petroleum and mud water may be attenuated within a relatively short distance along the pipe. Additional and/or different physical processes may (at least in part) be present in other cases.

In one embodiment, a duty ratio of the rectangular wave is dynamically adjusted. Accordingly, the ultralow frequency pulses output by the rectifying circuit 1103 have continuously changed front edges that approximate a square wave front edge. In some implementations, the continuously changed front edges may strengthen the ultralow frequency micro-surge hydraulic effect.

As described above, the third, ultralow frequency component of the electric wave can in some implementations include a wave having a substantially square wave front edge. As is known from Fourier analysis of a square wave front edge, the third component accordingly can include a relatively wide spectrum of high order harmonic waves. Experiments have shown that in some embodiments the frequencies of the high order harmonic waves can exceed approximately 100 kHz. In some cases, the high order harmonic waves can increase the resonance excitation energies provided to the particles in the flow of petroleum and mud water.

In some embodiments, the electric wave generator 3 can include a microprocessor 1101. In some such embodiments, the microprocessor 1101 can include a single chip microprocessor, which can be a central processor on a single integrated circuit chip. In some embodiments, more processors can be included. In some embodiments, the microprocessor 1101 provides the functionality of setting up initial values for the exciter 1 and the electric wave generator 3, monitoring and dynamically controlling the working condition of the exciter 1 and the electric wave 3 according to electrical feedback. For example, the microprocessor 1101 can set up a basic output frequency for the oscillator 1106 so that the oscillator 1106 outputs the high frequency alternating wave having this basic output frequency. In some cases, the basic output frequency is approximately 36 kHz. The microprocessor 1101 can also set up a swing frequency for the swing oscillator 1104 so that the swing oscillator 1104 outputs a low frequency sine wave having this swing frequency and consequently the oscillator 1106 swings the frequency of the high frequency alternating wave by an amount corresponding to the swing frequency. The microprocessor 1101 can set up a duty ratio so that the rectangular wave generator 1102 outputs the ultralow frequency rectangular wave having this duty ratio. For example, in one embodiment, the duty ratio for the rectangular wave is 20:80. In another embodiment, the duty ratio for the rectangular wave is 90:10. In another embodiment, the duty ratio is 50:50 (e.g., a square wave). In another embodiment, the duty ratio for the rectangular wave is continuously changed in time.

In some embodiments, the microprocessor 1101 can receive one or more feedbacks from the exciter 1. For example, the microprocessor 1101 can receive one or more of a temperature feedback indicating the temperature of the wires of the field windings, a current feedback indicating the current value in the wires of the field windings, and a pressure feedback indicating the pressure within the oil well. Based at least in part on these feedbacks (and/or other possible feedbacks), the microprocessor 1101 can dynamically adjust the working condition of some or all of the electric wave components produced by the electric wave generator 3. For example, the microprocessor 1101 can dynamically set the excitation current value for the field windings, dynamically set the high frequency, the low frequency, and/or the ultralow frequency of the composite electric wave to accommodate the geology of different oil fields, to prevent the field windings from overheating and/or overloading, to prevent the pumping units from operating while substantially no petroleum is pumped out, and so forth.

In petroleum applications, the flow in the pipe typically includes petroleum and mud water. In some oil fields the petroleum is more wax-like whereas in other oil fields the petroleum is more glue-like. Also, the amount of mud water varies from site to site. The properties of the exciter 1 can be adjusted based in part on the properties of the petroleum at a particular site. In some cases, the exciter 1 can be used for a period of time to develop usage statistics that assist in determining the most suitable exciter properties for the site. For example, different currents can be applied to the field windings and the usage statistics can indicate which current is the most effective at reducing deposits.

As discussed above, embodiments of the exciter 1 can include a plurality of field windings, which include a number of turns of wire. In particular implementations, the number of turns of wire in a field winding, the number of field windings, and/or the current applied to the windings can be suitably varied based on the usage statistics at the particular oil field. For example, in an oil field producing wax oil, an exciter comprising 5 windings, each with 1240 turns can be used (6200 turns total). In one example oil well, a 5 Ampere current can be used, and the exciter can produce 31,000 ampere-turns (6200 turns times 5 Amperes). In another example, in an oil field producing glue oil, an exciter comprising 5 windings, each with 1240 turns can be used (6200 turns total). In one example oil well, a 6 Ampere current can be used, and the exciter can produce 37,200 ampere-turns (6200 turns times 6 Amperes).

In some embodiments, one or more of the field windings of the exciter 1 can be above tens of thousands of ampere-turns. In order to reduce or prevent damage from strong opposite electrodynamic potentials due to the pulse waves, the microprocessor 1101 can be configured to control relevant components of the electric wave generator 3 to slowly turn on, slowly turn off, and/or slowly modulate the pulses. In addition, because the rectifying circuit 1103 can operate substantially continuously in hot and/or humid environmental conditions, the microprocessor 1101 can be configured to control cooling, current limitations, etc. of the rectifying circuit 1103 (and/or other components shown in FIG. 11).

Figure 11A:
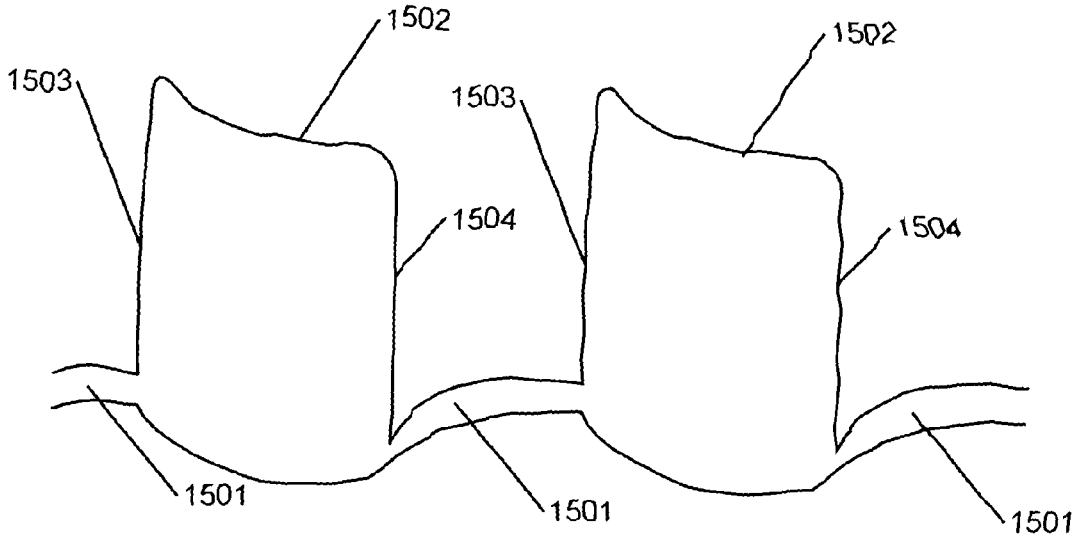
FIG. 11A schematically illustrates an example envelope of an embodiment of an electric wave.

As described above, in certain embodiments, the electric wave generator 3 generates an electric wave that includes one or more components. FIG. 11A schematically illustrates an envelope of the amplitude of the electric wave produced by one embodiment of the electric wave generator 3. As will be understood by a person skilled in the art, the amplitude of the electric wave oscillates in time within the envelope shown in FIG. 11A. In this example, the electric wave includes three components: (1) a high frequency component 1501, (2) a low frequency component 1502, and (3) ultralow frequency components 1503, 1504. For example, the high frequency component 1501 can include a sinusoidal oscillation in a range from approximately 25 kHz to approximately 65 kHz; the low frequency component 1502 can include a sinusoidal oscillation in a range from approximately 25 Hz to approximately 240 Hz; and the ultralow frequency component 1503, 1504 can include a rectangular pulse train at a frequency of approximately 0.1 Hz to approximately 10 Hz. In the example shown in FIG. 11A, switch-modulation of a thyristor is used to modulate the low frequency component. For example, the thyristor is turned on at times corresponding to front edges 1503 of the ultralow frequency component, and the thyristor is turned off at times corresponding to the tails 1504 of the ultralow frequency component. In this example, the ratio of the amplitude of the low frequency wave to the high frequency wave is approximately 10 to 1.

In some embodiments, the electric wave includes some, but not all, of these three components, for example, the low frequency component and the ultralow frequency component, or the high frequency component and the low frequency component, and so forth. In some embodiments, the frequency of the high frequency component, if present, can optionally be modulated at a rate between approximately 0 Hz and approximately 10 kHz (e.g., approximately 5 kHz). In some embodiments, the amplitude of the low frequency component to the high frequency component is in a range from approximately 10-to-1 to approximately 15-to-1. Other amplitude ratios can be used. For example, usage statistics at a particular oil field may be used to select the amplitudes, frequencies, and/or phases of the wave components to provide optimal reduction in deposits for the geology at that oil field.

The electric wave generator 3 communicates the electric wave to the field windings of the exciter 1. In some embodiments, the electric wave is communicated to each of the field windings of the exciter. In other embodiments, electric waves comprising a different selection of frequency components are applied to different field windings of the exciter. For example, a first field winding can receive the high frequency component, and a second field winding can receive the low frequency and ultralow frequency components. Many variations are possible.

Figure 11B:
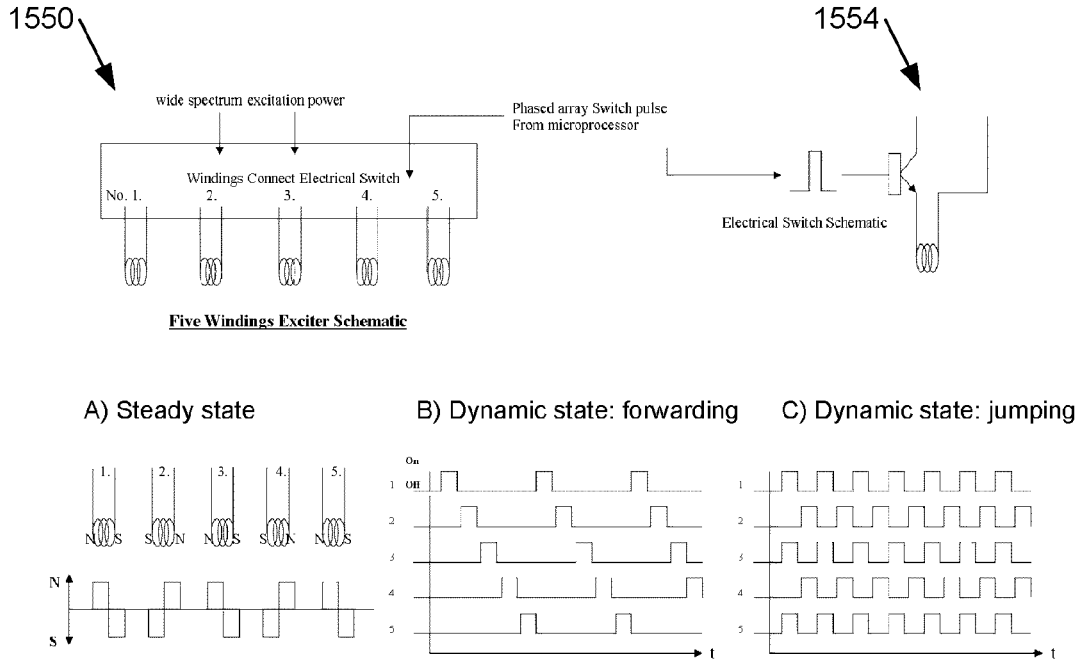
FIG. 11B schematically illustrates examples of switch and timing diagrams for a phased array for an embodiment of an exciter comprising five windings.

In some embodiments of the exciter 1, a phased array of field windings is used in which each winding includes a switch that permits the microprocessor 1101 to control the times when the electric wave is applied to the winding. FIG. 11B schematically illustrates a switch timing schematic diagram for an example embodiment of an exciter 1550 comprising five field windings (labeled No. 1 to No. 5). In this embodiment, one or more transistors can be used as the switch 1554. In some embodiments, the switch 1554 is configured to pass a direct current (e.g., with a time-varying amplitude) to the winding. In other embodiments, the switch 1554 can be configured to pass an alternating current to the winding. The exciter 1550 receives a series of switch pulses from the microprocessor 1101, and in response, the switches for each winding permit current to pass to the winding. A wide variety of phasing effects can be generated in such embodiments. For example, as shown in inset (A) of the figure, the DC polarities of the current pulses communicated to windings 2 and 4 is opposite in sign to the polarities of the pulses communicated to windings 1, 3, and 5. Accordingly, the arrangement of magnetic poles in this example is NSSNNSSNNS. Insets (B) and (C) schematically illustrate examples of dynamic phasing (termed forwarding and jumping, respectively) in which switch pulses are communicated to the windings in a temporal sequence. For example, in (B), only one winding is "on" (e.g., receiving current) at any given time, and each winding is turned on sequentially. In example (C), windings 1, 3, and 5 are "on" at the times when windings 2 and 4 are "off" (e.g., not receiving current), and vice-versa. Many different timing diagrams may be used in different embodiments of the exciter.

In response to the received electric wave, the field windings produce electromagnetic fields comprising corresponding high frequency, low frequency, and/or ultralow frequency components. The generated electromagnetic fields (which as known from Maxwell's laws may include electric fields and/or magnetic fields) may be useful for reducing or preventing deposits in petroleum pipes. For example, in some implementations, deposits may be produced or formed in one or more of stages, which may include: (1) prior to wax molecules or dirt particles being segregated from the flow of petroleum and mud water; (2) subsequent to wax molecule or dirt clusters or bumps being segregated from the flow but prior to their deposition on the inner surfaces of the petroleum pipes or on the outer surfaces of pumping rods; and (3) subsequent to wax molecule or dirt clusters or bumps having deposited on the inner surfaces of the petroleum pipes or on the outer surfaces of pumping rods. The apparatus and methods described herein may reduce (or prevent) deposits in some or all of these stages as well as in other stages.

In some cases, the advantages of using high frequency, low frequency, and/or ultralow frequency electromagnetic fields can be enhanced by using one or more of the field winding arrangements shown and described with reference to FIGS. 2 to 9. For example, the field windings of the exciter can be arranged to collectively produce a resultant magnetic field geometry that can have serially changed magnetic poles and field lines that can be substantially non-parallel and/or substantially non-perpendicular with respect to the pipe axis 15. The magnetic field thus produced can have non-fixed magnetic poles, non-fixed frequencies, non-fixed magnetic field strengths, non-pure sine wave and/or pulse excitation, and/or non-collinear and nonsymmetric magnetic fields. In some implementations, such a magnetic field may increase efficacy of the disclosed apparatus and methods, e.g., by increasing the micro-surge hydraulic effect.

Figure 12:
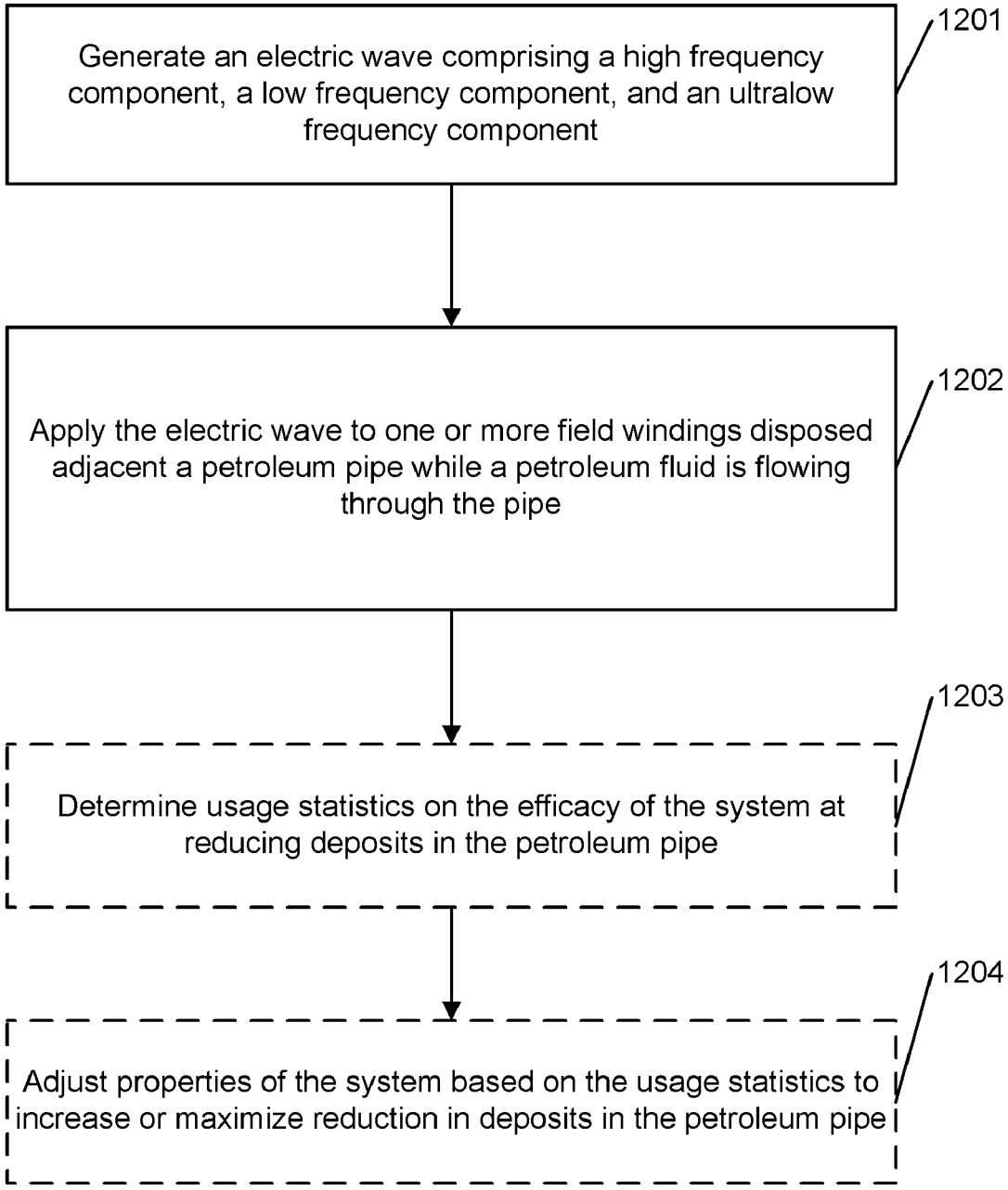
FIG. 12 is a flowchart illustrating an example of a method of reducing or preventing deposits in a petroleum pipe.

FIG. 12 is a flowchart illustrating an example of a method of preventing deposits in petroleum pipes. In block 1201, an electric wave is generated. The electric wave can include a high frequency component, a low frequency component, and/or an ultralow frequency component. Some or all of these components can be generated using embodiments of the electric wave generator shown and described with reference to FIG. 11. For example, the high frequency component may include a high frequency in a range from approximately 25 kHz to approximately 65 kHz, the low frequency component may include a low frequency in a range from approximately 25 Hz to approximately 240 Hz, and the ultralow frequency component may include an ultralow frequency in a range from approximately 0.1 Hz to approximately 10 Hz. In block 1202, the electric wave is applied to one or more field windings circumferentially disposed around a petroleum pipe. For example, the field windings can be configured as shown in the examples illustrated in FIGS. 2-9. As discussed above, the electric wave applied to the field windings generates magnetic (and/or electromagnetic) fields that extend into petroleum fluid (e.g., petroleum and mud water) flowing in the pipe. The applied magnetic (and/or electromagnetic) fields reduce or prevent deposits in the pipe as described above. In some embodiments of the method, in optional block 1203, the properties of the applied electric wave are varied to determine usage statistics relevant to which properties of the electric wave are most effective at reducing deposits. For example, the current and/or voltage of the wave (or the individual wave components) may be varied. In some cases, the frequencies of the wave components are varied or modulated. In some implementations, the number of field windings and/or the number of turns in particular field windings are varied. A skilled artisan will recognize that a wide range of usage statistics may be gathered relevant to performance of the system. In optional block 1204, the properties of the system are adjusted based at least in part on the usage statistics to increase or maximize deposit reduction. Accordingly, certain embodiments of the method are used to "tune" the system to increase or optimize the performance of the system at reducing deposits for the particular petroleum fluid at a particular oil field.

Embodiments of the example method illustrated in FIG. 12 may be implemented on an outlet branch of a Christmas tree at an oil well or on an outlet branch of an oil transporting station. The embodiments described above can be utilized at various types of oil wells, including natural-flow oil wells, and oil wells utilizing artificial lifting mechanisms, such as pump lift mechanisms, chain pumping units, and/or sucker rod bumping units. In certain embodiments implemented at oil wells, the exciter 1 includes two to twelve field windings. The embodiments described above can also be utilized at oil transporting stations along petroleum pipelines having lengths of hundreds and thousands of miles. In certain embodiments implemented at oil transporting stations, the exciter 1 includes ten to fifty field windings.

Any of the methods described above may be implemented in a computer system comprising one or more general and/or special purpose computers. Embodiments of the methods may be implemented as hardware, software, firmware, or a combination thereof. Various illustrative components, blocks, modules, circuits, and steps have been described above generally in terms of their functionality. Whether such functionality is implemented as hardware, firmware, or software depends upon the particular application and design constraints imposed on the overall system. Skilled artisans may implement the described functionality in varying ways for each particular application, but such implementation decisions should not be interpreted as causing a departure from the scope of this disclosure.

Any illustrative logical blocks, modules, and circuits described in connection with the embodiments disclosed herein may be implemented in or performed by an integrated circuit (IC), an access terminal, or an access point. The IC may include a general purpose processor, a digital signal processor (DSP), an application specific integrated circuit (ASIC), a field programmable gate array (FPGA) or other programmable logic device, discrete gate or transistor logic, discrete hardware components, electrical components, optical components, mechanical components, or any combination thereof designed to perform the functions described herein, and may execute codes or instructions that reside within the IC, outside of the IC, or both. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the embodiments disclosed herein may be embodied directly in hardware, in a software module executed by a processor, or in a combination of the two. A software module may reside in RAM memory, flash memory, ROM memory, EPROM memory, EEPROM memory, registers, a hard disk, a removable disk, a CD-ROM, a DVD, or any other form of storage medium known in the art. An example storage medium may be coupled to the processor such the processor can read information from, and write information to, the storage medium. In the alternative, the storage medium may be integral to the processor. The processor and the storage medium may reside in an ASIC. The ASIC may reside in a user terminal. In one alternative, the processor and the storage medium may reside as discrete components in a user terminal.

Example embodiments described herein may have several features, no single one of which is indispensable or solely responsible for their desirable attributes. In any method or process disclosed herein, the acts or operations of the method or process may be performed in any suitable sequence and are not necessarily limited to any particular disclosed sequence. Additionally, the structures, systems, apparatus, and/or devices described herein may be embodied as integrated components or as separate components. For purposes of comparing various embodiments, certain aspects and advantages of these embodiments are described. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein.

Reference throughout this specification to "some embodiments" or "an embodiment" means that a particular feature, structure or characteristic described in connection with the embodiment is included in at least some embodiments. Thus, appearances of the phrases "in some embodiments" or "in an embodiment" in various places throughout this specification are not necessarily all referring to the same embodiment and may refer to one or more of the same or different embodiments. Furthermore, the particular features, structures or characteristics may be combined in any suitable manner in one or more embodiments, as would be apparent to one of ordinary skill in the art from this disclosure. Additionally, although described in the illustrative context of certain preferred embodiments and examples, it will be understood by those skilled in the art that the disclosure extends beyond the specifically described embodiments to other alternative embodiments and/or uses and obvious modifications and equivalents. Thus, it is intended that the scope of the claims which follow should not be limited by the particular embodiments described above.

What is claimed is:

1. A method of reducing deposits in a petroleum pipe, the method comprising:

generating an electric wave comprising a high frequency component, a low frequency component, and an ultralow frequency component, the high frequency component comprising a high frequency in a range from approximately 25 kHz to approximately 65 kHz, the low frequency component comprising a low frequency in a range from approximately 25 Hz to approximately 240 Hz, and the ultralow frequency component comprising an ultralow frequency in a range from approximately 0.1 Hz to approximately 10 Hz;

applying the electric wave to a plurality of field windings circumferentially disposed around a petroleum pipe while a petroleum fluid is flowing in the petroleum pipe, the plurality of field windings comprising at least a first field winding and a second field winding;

generating with the first field winding, in response to the electric wave, a first magnetic field having a first magnetic axis; and generating with the second field winding, in response to the electric wave, a second magnetic field having a second magnetic axis, the second magnetic axis noncollinear with respect to the first magnetic axis.

2. The method of claim 1, wherein an angle between the first magnetic axis and the second magnetic axis is greater than 0 degrees and less than approximately 30 degrees.

3. The method of claim 1, wherein the pipe has a pipe axis that defines a direction for fluid flow in the petroleum pipe, and at least the first magnetic axis is noncollinear with respect to the pipe axis.

4. The method of claim 3, wherein the second magnetic axis is noncollinear with respect to the pipe axis.

5. The method of claim 1, wherein applying the electric wave to the plurality of field windings comprises phasing times at which the electric wave is applied to at least some of the plurality of field windings.

6. The method of claim 1, wherein generating the electric wave comprises providing a ratio of an amplitude of the low frequency component to an amplitude of the high frequency component that is in a range from approximately 10 to approximately 15.

7. The method of claim 1, further comprising modulating the high frequency component of the electric wave at a modulation frequency.

8. The method of claim 7, wherein the modulation frequency is less than approximately 10 kHz.

9. The method of claim 1, further comprising:

converting an input alternating current into the low frequency component of the electric wave; and outputting a rectangular wave at the ultralow frequency.

10. The method of claim 1, further comprising selecting at least one of the high frequency, the low frequency, and the ultralow frequency based at least in part on the properties of the petroleum fluid flowing in the pipe.

11. The method of claim 10, further comprising determining usage statistics for the efficacy of deposit reduction for different properties of the electric wave, and wherein selecting comprises selecting based at least in part on the usage statistics.

12. The method of claim 1, further comprising adjusting at least one of the high frequency, the low frequency, and the ultralow frequency based at least in part on a feedback.

13. The method of claim 12, wherein the feedback comprises at least one of: (i) a temperature feedback indicating a temperature of at least one of the plurality of field windings, (ii) a current feedback indicating a current in at least one of the plurality of field windings, and (iii) a pressure feedback indicating a pressure in the petroleum fluid.

14. A method of reducing deposits in a petroleum pipe, the method comprising:

generating an electric wave comprising a high frequency component comprising a high frequency in a range from approximately 25 kHz to approximately 65 kHz;

applying the electric wave to at least two field windings circumferentially disposed around a petroleum pipe while a petroleum fluid is flowing in the petroleum pipe; and generating, in response to the applied electric wave, magnetic fields in the at least two field windings, the magnetic fields in the at least two field windings having magnetic axes that are not collinear with respect to each other.

15. The method of claim 14, wherein generating the electric wave further comprises generating a low frequency component comprising a low frequency in a range from approximately 25 Hz to approximately 240 Hz.

16. The method of claim 14, wherein generating the electric wave further comprises generating an ultralow frequency component comprising an ultralow frequency in a range from approximately 0.1 Hz to approximately 10 Hz.

17. The method of claim 14, wherein the pipe has a pipe axis that defines a direction for fluid flow in the petroleum pipe, and wherein generating the magnetic fields comprises generating, in at least one of the at least two field windings, a magnetic field that has a magnetic axis that is noncollinear with respect to the pipe axis.

18. The method of claim 14, further comprising modulating the high frequency component of the electric wave at a modulation frequency.

19. The method of claim 18, further comprising selecting at least one of the high frequency and the modulation frequency based at least in part on the properties of the petroleum fluid flowing in the pipe.

* * * * *

UNITED STATES PATENT AND TRADEMARK OFFICE

CERTIFICATE OF CORRECTION

PATENT NO. : 7,892,360 B2
APPLICATION NO. : 12/793482
DATED : February 22, 2011
INVENTOR(S) : Qi Ning Mai It is certified that error appears in the above-identified patent and that said Letters Patent is hereby corrected as shown below:

In column 5 at line 46, change “la” to --1a--.

In column 6 at line 11, change “nonlinear” to --noncollinear--.

Signed and Sealed this
Thirteenth Day of September, 2011

David J. Kappos
*Director of the United States Patent and Trademark Office*